US006322426B1

(12) United States Patent
Akagi et al.

(10) Patent No.: US 6,322,426 B1
(45) Date of Patent: Nov. 27, 2001

(54) METHOD FOR MIRROR PROCESS OF EXTERNAL SURFACE OF LONG SIZED METAL

(75) Inventors: Kazuo Akagi; Tomohisa Akiyoshi; Yoshimitu Nakashima, all of Shimonoseki (JP)

(73) Assignee: Nissin Unyu Kogyo Co., Ltd., Shimonoseki (JP)

( * ) Notice: Subject to any disclaimer, the term of this patent is extended or adjusted under 35 U.S.C. 154(b) by 0 days.

(21) Appl. No.: 09/417,657

(22) Filed: Oct. 14, 1999

(30) Foreign Application Priority Data

Oct. 14, 1998 (JP) ..... 10-292031

(51) Int. Cl.[7] ..... B24B 1/00

(52) U.S. Cl. ..... 451/49; 451/57; 451/58; 451/324

(58) Field of Search ..... 451/28, 49, 57, 451/58, 319, 324, 190, 194, 209, 210, 242, 246

(56) References Cited

U.S. PATENT DOCUMENTS 3,101,577 * 8/1963 Skugghall .
3,800,117 * 3/1974 Anderson .
3,813,911 * 6/1974 Bibighaus .
4,063,906 * 12/1977 Wetzels .
5,759,089 * 6/1998 McCoy ..... 451/49
6,113,464 * 9/2000 Ohmori et al. ..... 451/41

* cited by examiner

*Primary Examiner*—Timothy V. Eley
(74) *Attorney, Agent, or Firm*—Nixon Peabody LLP; David S. Safran

(57) ABSTRACT

A method for mirror processing of an external surface of a long-sized metal piece, by which the external surface is mirror-polished with precision and high efficiency without a surface defect or so that stable dimensional accuracy, such as a roundness and improvement of yield in production, can be obtained. The method comprises the steps of clamping both ends of a long-sized metal piece, applying a positive electrical charge and rotating the metal piece, and moving the long-sized metal in the axial direction through an electrolytic integrated polishing apparatus for processing the external surface of a long-sized metal piece into a mirror surface. The electrolytic integrated polishing apparatus includes a plurality of grindstones pressed onto the long-sized metal piece from the opposite directions or from outside to the rotation axis radially at a constant pressure, and negative electrodes disposed so that each of the grindstones is disposed between the electrodes in the circumferential direction so as to integrate abrasion of the long-sized metal piece by grindstones and concentration elution by an electrolyte for mirror processing of the external surface of the long-sized metal piece.

7 Claims, 5 Drawing Sheets

METHOD FOR MIRROR PROCESS OF EXTERNAL SURFACE OF LONG SIZED METAL

BACKGROUND OF THE INVENTION

1. Field of the Invention

The present invention relates to a method for mirror processing of an external surface of a long-sized cylindrical or a bar-like shaped piece that is formed of a metal, such as aluminium, stainless steel (SUS), or carbon steel.

2. Description of Related Art

In order to mirror process the external surface of a long-sized metal piece, a conventional cylinder centerless grinding machine is used, through which the long-sized metal piece is passed once or plural times in accordance with a quality of the material and a required surface coarseness of products.

In this case, some problems may occur easily, such as drop of productivity (i.e., low polished production or increase of grindstone wearing) due to clogging of the grindstone, interference with a receiving plate for supporting the long-sized metal piece to be polished or roller blades, or a surface defect, e.g., scratches due to biting of grind grains. Therefore, various provisions and controls are necessary.

The above-mentioned conventional technique has many problems to be solved adding to the low productivity and surface defects. They are quality drops, e.g., dimensional accuracy, such as roundness, or a surface coarseness, a yield drop in production, and a cost increase due to the need to perform several processing passes to produce a super fine finishing.

SUMMARY OF THE INVENTION

The object of the present invention is to solve the above mentioned problems, and to provide a method for mirror processing of the external surface of a long-sized metal piece by which the external surface of the long-sized metal piece can be given mirror finish with high precision and high efficiency without resulting in a surface defect. The method should also provide stable dimensional accuracy, such as a roundness and improvement of yield in production.

In order to attain the above-mentioned object, the method for mirror processing of the external surface of a long-sized metal piece comprises the steps of supporting the long-sized metal piece at both ends thereof using clamp means, applying a positive charge to the long-sized metal piece and rotating the metal piece while moving it the axial direction, pressing a plurality of grindstones onto the external surface of the long-sized metal piece from opposite directions or from outside radially toward the axis of rotation at a constant pressure, disposing negative electrodes in such a way that each of the grindstones is disposed between the electrodes in the circumferential direction, feeding electrolyte to the external surface of the long-sized metal piece via an electrolyte feeding means. By integrating abrasion of the long-sized metal by grindstones and concentration elution by electrolyte, the external surface of the long-sized metal is mirror-processed in high precision and in high efficiency.

In this method for mirror processing of the external surface of a long-sized metal piece, a housing for retaining the grindstones is preferably swung along the axial direction of the long-sized metal piece, and the swinging movement is combined with the movement of the long-sized metal piece.

In another aspect, the method for mirror processing of the external surface of a long-sized metal piece with high precision and high efficiency comprises the steps of supporting the long-sized metal piece at both ends and applying a positive charge while rotating the metal, moving an electrolytic integrated polishing apparatus comprising a housing with a plurality of grindstones, negative electrodes and electrolyte feeding means along the axial direction of the long-sized metal piece, while swinging the electrolytic integrated polishing apparatus in accordance with necessity.

The grindstones preferably include different types, such as coarse, medium, finishing, arranged in multiple stages at a predetermined interval along the axial direction of the long-sized metal piece from the long-sized metal piece supplying side, and each stage includes a plurality of grindstones arranged in the circumferential direction at a predetermined angle interval. The electrolyte is fed from the fine grindstone side.

Furthermore, the long-sized metal piece preferably has a cylindrical or a bar-like shape.

Hereinafter, embodiments of the present invention will be described with reference to the accompanying drawings.

BRIEF DESCRIPTION OF THE DRAWINGS

FIGS. 5A and 5B are the case of two grindstones. FIGS. 5C and 5D are the case of three grindstones. FIGS. 5E and 5F are the case of five grindstones.

DETAILED DESCRIPTION OF THE INVENTION

Figure 1:
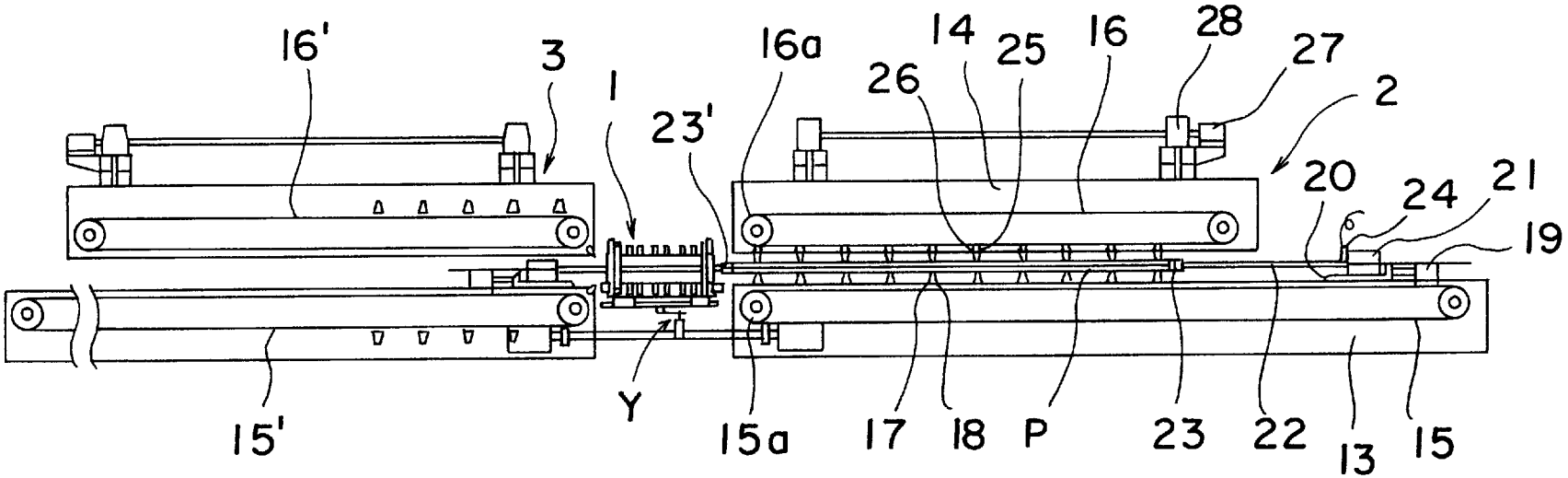
FIG. 1 is a schematic diagram of an overall equipment according to an embodiment of the present invention.

FIG. 1 shows an embodiment of the method according to the present invention, in which an electrolytic integrated polishing apparatus 1 is disposed between a first moving means 2 having a retaining mechanism and a second moving means 3 having a retaining mechanism, and which are aligned.

Figure 2:
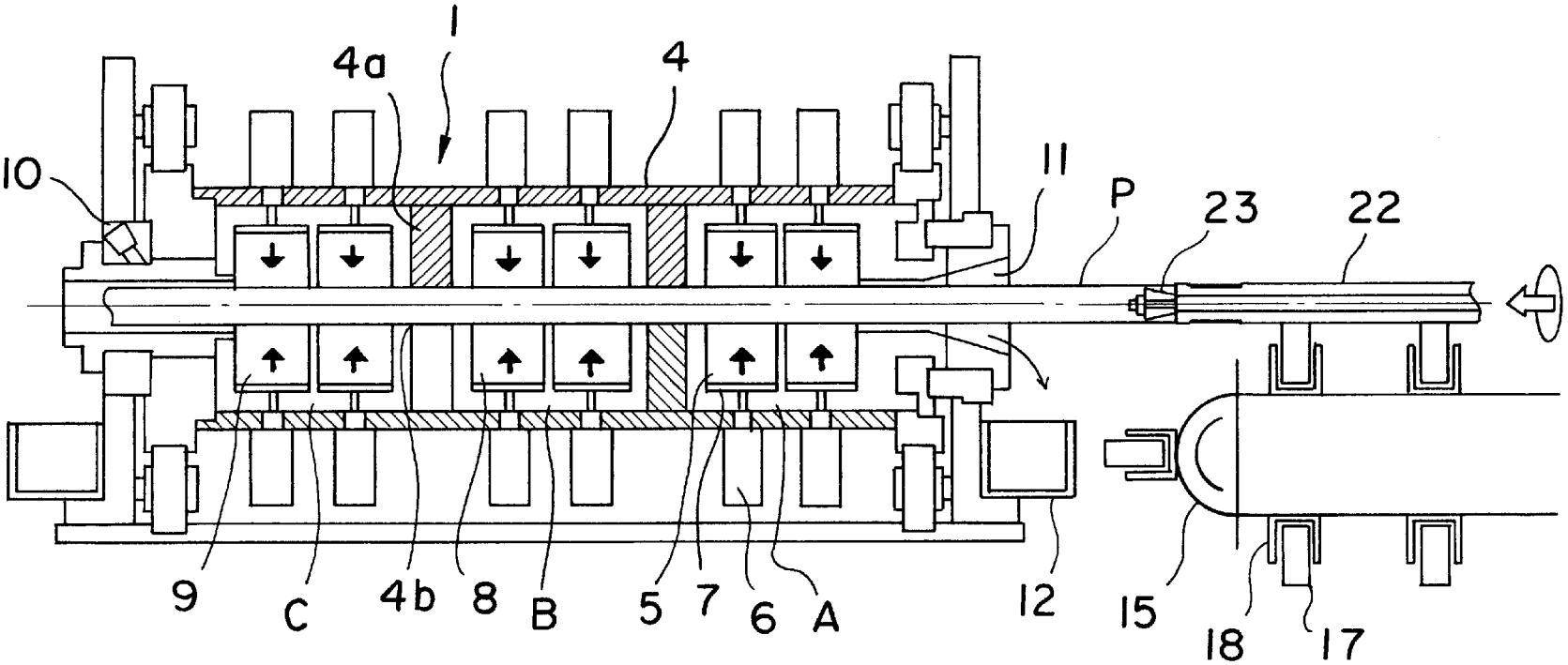
FIG. 2 is a cross section of an electrolytic integrated polishing apparatus and periphery thereof.

The electrolytic integrated polishing apparatus 1 includes a housing 4 and partitions 4*a* disposed therein, which define a coarse polishing area A, a medium polishing area B and a finish polishing area C, and a middle portion of each partition 4*a* is provided with a through hole 4*b* as a passage of a long-sized metal piece tube P. as shown in FIG. 2.

The coarse polishing area A is provided with two rows front and rear) of coarse grindstones 5 arranged opposite each other, and each of which is retained by a cylinder 6 attached to the housing 4 and a grindstone holder 7 fixed at the distal end of the cylinder 6. In the same way, the medium polishing area B and the finish polishing area C are provided with two rows of medium grindstones 8 and finishing grindstones 9, arranged opposite each other. In addition, negative electrodes (see FIG. 5) are disposed so that each of the grindstones is disposed between the electrodes in the circumferential direction.

Furthermore, the housing 4 is provided with an electrolyte feed port 10 at the front end, and an electrolyte discharge port 11 at the rear end. In addition, an electrolyte-recovering bath 12 is disposed below the electrolyte discharge port 11.

The first moving means 2 comprises a lower bridge 13 which is fixed on a base as shown in FIG. 1, and an upper bridge 14 that can move vertically. The lower bridge 13 has a lower conveyer chain 15, while the upper bridge 14 has an upper conveyer chain 16, respectively, in the direction from the front to the rear, as shown in FIG. 1.

To the lower conveyer chain 15, plural receiving rollers 17 are attached via brackets 18 at a predetermined interval, and a linear actuator 19 is disposed at a predetermined position, as shown in FIGS. 1 and 2. To this linear actuator 19, an electric motor 21 is fixed via an attachment table 20 for rotating a clamping shaft 22, whose distal end is provided with clamp means 23 for retaining an end of the long-sized metal tube P. The rear end of the clamp shaft 22 abuts an electric contact 24 for charging the long-sized metal piece tube P in the positive electricity via the clamp shaft 22 and the clamp means 23.

To the upper conveyer chain 16, plural pressing rollers 25 are attached via brackets 26 at a predetermined interval, and a driving motor 27 is disposed above the upper bridge 14. This driving motor 27 rotates driving sprockets 16*a* and 15*a* for the upper and lower conveyer chains 16 and 15 simultaneously and in the opposite directions so that both of the conveyer chains can move in the same direction. Numeral 28 denotes a linear actuator for moving the upper bridge 14 vertically.

The second moving means 3 is symmetric with the first moving means 2. Therefore, detailed explanation thereof will be omitted, and the corresponding element will be indicated by the same numeral with a prime mark (')

Next, the polishing method will be explained. As shown in FIG. 1, a long-sized metal tube P having a length of about 4–6 meters is retained at both ends by the clamp means 23 of the first moving means 2 and the clamp means 23' of the second moving means 3. The clamp means 23' penetrates the inside of the electrolytic integrated polishing apparatus 1 and protrudes toward the first moving means 2.

After clamping the long-sized metal tube P, the upper bridge 14 is moved downward so that the pressing rollers 25 abut the external surface of the long-sized metal tube P. Thus, the long-sized metal tube P is supported securely by the pressing rollers 25 and the receiving rollers 17 of the lower bridge 13.

Then, the motor 21 rotates the long-sized metal piece tube P at a high speed via the clamp shaft 22, and a negative electrical charge is applied to the long-sized metal tube P via the electric contact 24. The upper conveyer chain 16 and the lower conveyer chain 15 of the first moving means 2 are moved in the forward direction, and synchronized to this movement, the upper conveyer chain 16' and the lower conveyer chain 15' of the second moving means 3 is also moved in the forward direction, so as to supply the long-sized metal tube P into the electrolytic integrated polishing apparatus 1.

The long-sized metal tube P fed into the electrolytic integrated polishing apparatus 1 is pressed by the grindstones 5 with an appropriate pressure applied by the cylinder 6 in the coarse polishing area A, and the electrolyte is supplied to the external surface of the long-sized metal tube P via the electrolyte feed port 10. By integrating abrasion of a passivation coating formed on the external surface of the long-sized metal tube P by the coarse grindstones 5 and concentration elution by the electrolyte, the external surface is polished coarsely.

Next, along with the forward moving of the long-sized metal tube P, medium polishing in the medium polishing area B and finish polishing in the finish polishing area C are performed sequentially. Thus, three polishing stages, i.e., coarse, medium and finish polishing stages are performed sequentially. After being polished, the long-sized metal tube P exits from the electrolytic integrated polishing apparatus 1 and is transferred to the second moving means 3.

The wasted electrolyte containing grains of metal ground off during the polishing is discharged from the electrolyte discharge port 11 to the electrolyte recovering bath 12 so that the grains do not remain on the finished surface of the long-sized metal tube P. Then, the wasted electrolyte flows from the electrolyte recovering bath 12 to a sedimentation tank of an electrolyte feeding system (not shown), and after being filtered, the cleaned electrolyte is fed back to the electrolyte feed port 10.

In this way, the three polishing stages are performed over the entire length from the front end to the rear end of the long-sized metal tube P. and the polishing is finished when the rear end of the long-sized metal tube has passed the electrolytic integrated polishing apparatus 1. By repeating this operation, the external surface of the long-sized metal tube P is mirror-finish processed continuously with high precision and high efficiency. Since the long-sized metal tube P is retained by the clamp means at both ends and is supported securely over the entire length thereof by the pressing rollers and receiving rollers while being polished, dimensional accuracy, such as a roundness, will be improved to attain a high quality products and yield in production will be improved, too.

In the above explanation, the electrolytic integrated polishing apparatus 1 does not move. However, as shown in FIG. 1, appropriate swinging means Y can be provided for swinging the housing 4. Thus, the housing 4 may be swung in the axial direction of the long-sized metal tube P, so that the movement of the long-sized metal tube P can be combined with the swinging of the electrolytic integrated polishing apparatus 1.

Figure 3:
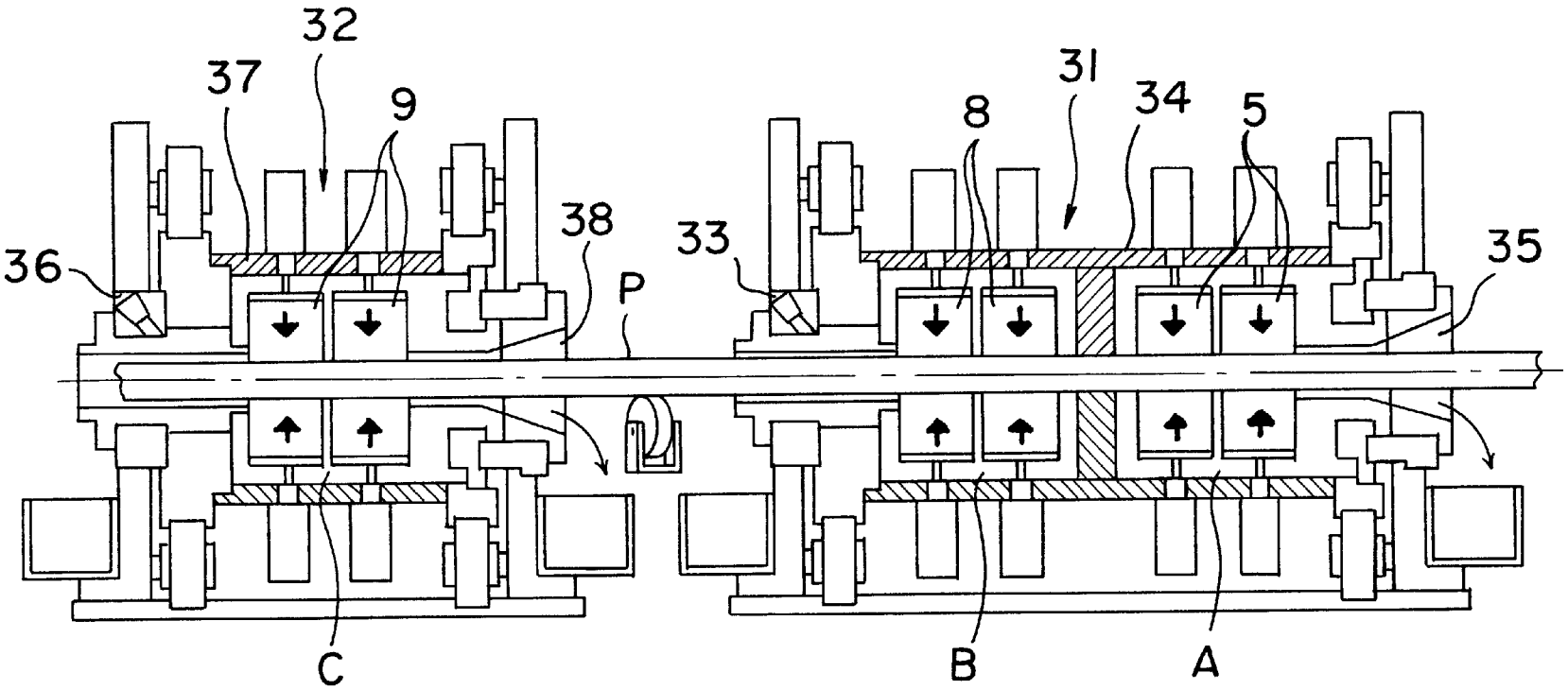
FIG. 3 is a cross section of another embodiment having a separate finish polishing area of the electrolytic integrated polishing apparatus.

FIG. 3 shows another embodiment of the method according to the present invention, which is different from the above-mentioned embodiment in that the finish polishing area is separate from other areas in the electrolytic integrated polishing apparatus. In other words, there are a first electrolytic integrated polishing apparatus 31 including the coarse polishing area A with coarse grindstones 5 and the medium polishing area B with medium grindstones 8, and a second electrolytic integrated polishing apparatus 32 including the finish polishing area C with finishing grindstones 9.

In this case, the first electrolytic integrated polishing apparatus 31 has an electrolyte feed port 33 at the medium polishing area B side front end of the housing 341 and the wasted electrolyte containing ground-off grains of metal is discharged from an electrolyte discharge port 35 disposed at the coarse polishing area A side rear end of the housing 34 so that the grind grains do not remain on the finished surface of the long-sized metal tube P. In contrast, the second electrolytic integrated polishing apparatus 32 has an electrolyte feed port 36 at the front end of the housing 37, and the wasted electrolyte containing the metal grains is discharged from an electrolyte discharge port 38 disposed at the rear end of the housing 37 so that the grains do not remain on the finished surface of the long-sized metal tube P.

The above-mentioned method is suitable especially for the mirror processing of a material that is hard to be machined or that is required to have super high quality, by controlling a density of the electrolyte and a standard for exchanging the electrolyte for the finish polishing in the second electrolytic polishing device 32 independently of those for the coarse polishing and the medium polishing in the first electrolytic integrated polishing apparatus 31.

Figure 4:
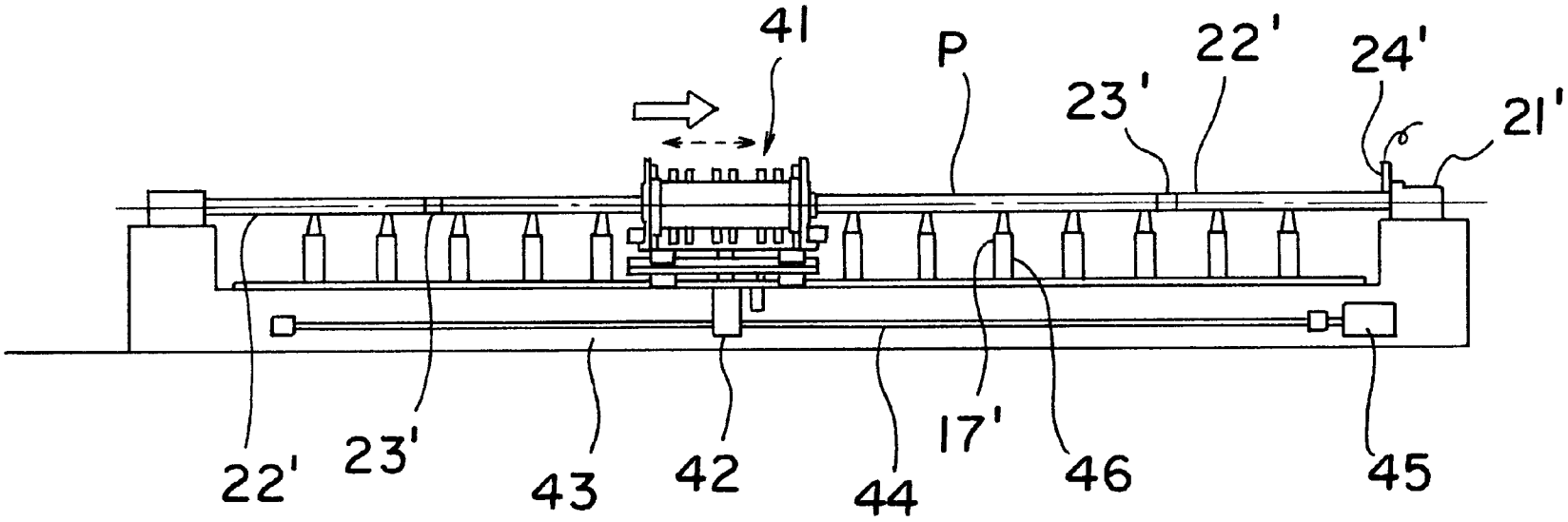
FIG. 4 is a schematic diagram of another embodiment having a movable electrolytic integrated polishing apparatus.

FIG. 4 shows still another embodiment of the method according to the present invention, in which the long-sized metal tube P is not moved, while an electrolytic integrated polishing apparatus 41 is moved along the long-sized metal tube P. In other words, the long-sized metal tube P is retained at both ends by a clamp means 23' of clamp shafts 22', and is supported by a plurality of receiving rollers 17'. Then, the clamp shafts 22' are rotated by a motor 211 so as to rotate the long-sized metal tube P at high speed, while a positive electrical charge is applied to the long-sized metal tube P via an electric contact 24'.

The electrolytic integrated polishing apparatus 41 has a nut member 42 at the bottom thereof, which engages a feed screw 44 provided to a basement 43. When the feed screw 44 is rotated by a motor 45, the electrolytic integrated polishing apparatus 41 moves with the nut member 44. Thus, the electrolytic integrated polishing apparatus 41 is moved along long-sized metal tube P from the front end to the rear end thereof for the mirror process.

The receiving rollers 17' support the long-sized metal tube P so that the long-sized metal tube P does not bend at the stage of retaining the long-sized metal tube P at both ends by the clamp means 23' after feeding the long-sized metal tube P to the electrolytic integrated polishing apparatus 41 for polishing. While, at the polishing stage, the receiving rollers 17' are turned horizontally together with support columns 46 or are moved downward together with support columns 46 into the basement 43 so that the receiving rollers 17' do not disturb the movement of the electrolytic-integrated polishing apparatus 41.

It is possible to combine swinging of the electrolytic integrated polishing apparatus 41 with the simple movement thereof for the mirror polishing.

FIGS. 5A–5F show examples of the grindstone arrangement in the electrolytic integrated polishing apparatus, in which two to five grindstones are combined in accordance with an external diameter of the long-sized metal tube P. When disposing two grindstones, as shown, in FIG. 5A, the coarse grindstones 5 are disposed opposite each other so that the long-sized metal tube P is disposed therebetween. Reference G denotes a tool electrode member for forming passages for the electrolyte and for guiding the coarse grindstones 5. The tool electrode members G, with negative electrodes H, are disposed at both sides of the tips of the grindstones 5.

Figure 5A:
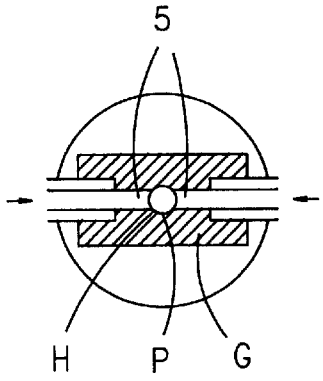
FIGS. 5A–5F illustrate examples of grindstone arrangement.
Figure 5B:
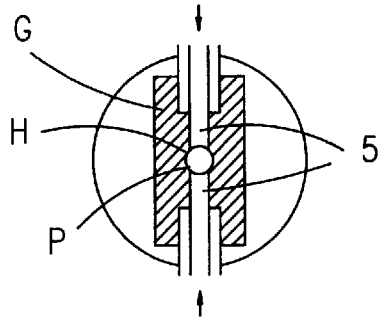

As shown in FIG. 1, when two rows (front and rear) of coarse grindstones 5 are used, the first row is arranged as shown in FIG. 5A, and the second row is arranged as shown in FIG. 5B so that the coarse grindstones 5 are shifted by 90 degrees in the circumferential direction of the long-sized metal tube P with respect to the arrangement of FIG. 5A.

Figure 5C:
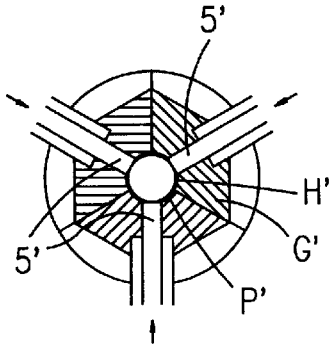
Figure 5D:
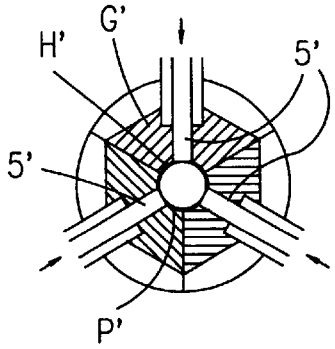

When disposing three grindstones, as shown in FIG. 5C, the coarse grindstones 51 are disposed at regular intervals (120 degrees) in the circumferential direction of the long-sized metal tube P'. In addition, when two rows (front and rear) of grindstones are used, the first row is arranged as shown in FIG. 5C,and the second row is arranged as shown in FIG. 5D so that the grindstones are shifted by 60 degrees in the circumferential direction with respect to the arrangement of FIG. 5C. Reference G' denotes a tool electrode member and reference H' denotes a negative electrode.

Figure 5E:
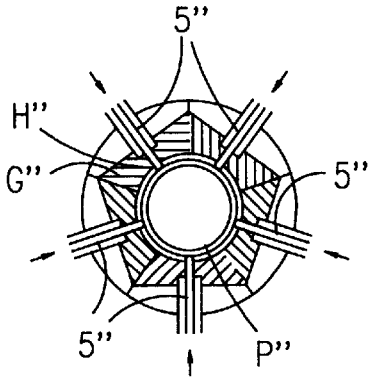
Figure 5F:
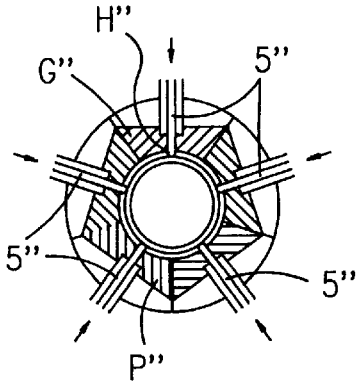

When disposing five grindstones, as shown in FIG. 5E, the coarse grindstones 5" are disposed at the regular interval of 72 degrees in the circumferential direction of the long-sized metal tube P". In addition, when two rows (front and rear) of grindstones are used, the first row is arranged as shown in FIG. 5E, and the second row is arranged as shown in FIG. 5F so that the grindstones are shifted by 36 degrees in the circumferential direction with respect to the arrangement of FIG. 5E. Reference G" denotes a tool electrode member and reference H" denotes a negative electrode. In this way, by increasing the number of grindstones along with the increasing external diameter of the long-sized metal tube P, the mirror process can be performed efficiently in a short time.

The above-mentioned examples of the grindstone arrangement are not limited to the coarse grindstones 5 in the coarse polishing area A, but can be applied to the medium grindstones 8 in the intermediate polishing area B and the fine grindstones 9 in the finish polishing area C.

Each of the above-mentioned embodiments is for a long-sized metal tube. However, the present invention can be applied similarly to the mirror process of the external shape of a long-sized metal round bar and is not limited to a long-sized metal round tube.

As mentioned above, the present invention provides a combination electrolytic polishing method in which fretting action by grindstones and concentration elution action by electrolyte are combined integrally, different from the conventional method. Therefore, surface defects, such as scratches which can be generated when using a centerless machining process, are not generated. Thus, excellent effects can be obtained, i.e., the external surface of the long-sized metal can be mirror-processed in high precision and in high efficiency, dimension accuracy such as a roundness will be stabilized, and yield in production will be improved.

What is claimed is:

1. A method of mirror-finishing an external surface of a long-sized metal piece with high precision and efficiency by integrating abrasion of the long-sized metal piece by grindstones and electropolishing by electrolyte, comprising the steps of:

arranging negative electrodes circumferentially between each of a plurality of grindstones;

clamping the long-sized metal piece at each of opposite ends thereof with a clamp means and with the grindstones positioned radially of the metal piece;

applying a positive charge to the long-sized metal piece;

rotating the metal piece while producing relative movement between the metal piece and the plurality of grindstones in an axial direction of the metal piece;

supplying electrolyte to the exterior surface of the long-sized metal piece via an electrolyte feeding means; and radially pressing the plurality of grindstones onto the exterior surface of the long-sized metal piece with a constant force in a direction perpendicular to a rotation axis of the metal piece.

2. A method of a mirror-finishing an external surface of long-sized metal piece according to claim 1, comprising the further step of mounting the grindstones in a housing which is adapted to oscillate in said axial direction.

3. A method of mirror-finishing an external surface of a long-sized metal piece according to claim 1, wherein said step of rotating the metal piece while producing relative movement in an axial direction between the metal piece and the plurality of grindstones is performed by moving an electrolytic integrated polishing apparatus, having a housing with said plurality of grindstones, the negative electrodes and the electrolyte feeding means in the axial direction of the long-sized metal piece, while the electrolytic integrated polishing apparatus is oscillating in the axial direction.

4. A method of mirror-finishing an external surface of a long-sized metal piece according to claim 1, wherein said step of rotating the metal piece while producing relative movement in an axial direction between the metal piece and the plurality of radially placed grindstones is performed by moving the metal piece.

5. A method of a mirror-finishing an external surface of long-sized metal piece according to claim 1 or 2 or 3, or 4, said method further comprising the use of different types of grindstones in different multiple stages at a predetermined interval in said axial direction of the long-sized metal piece, each stage including a plurality of grindstones arranged circumferentially of the metal piece at predetermined angular intervals; and wherein the electrolyte is fed in a direction from a last of the multiple stages toward a first of said stages.

6. A method of mirror-finishing an external surface of a long-sized metal piece according to claim 5, wherein said multiple stages comprise a coarse grinding station having coarse grindstones, a medium grinding station having medium grindstones, and finishing station having a finishing grindstones.

7. A method of mirror-finishing an external surface of a long-sized metal piece according to claim 1 or 2 or 3, or 4, wherein the long-sized metal piece is cylindrical or bar-shaped.

* * * * *